US011131280B2

(12) United States Patent
Suzuki et al.

(10) Patent No.: US 11,131,280 B2
(45) Date of Patent: Sep. 28, 2021

(54) INJECTOR ARRANGEMENT STRUCTURE

(71) Applicant: SUZUKI MOTOR CORPORATION, Hamamatsu (JP)

(72) Inventors: Kensuke Suzuki, Hamamatsu (JP); Atsushi Takaoka, Hamamatsu (JP); Junpei Yamaguchi, Hamamatsu (JP); Naotaka Kisakibaru, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 302 days.

(21) Appl. No.: 16/380,490

(22) Filed: Apr. 10, 2019

(65) Prior Publication Data

US 2019/0316552 A1 Oct. 17, 2019

(30) Foreign Application Priority Data

Apr. 13, 2018 (JP) ..... JP2018-077443

(51) Int. Cl.

| | |
|---|---|
| ***F02M 35/10*** | (2006.01) |
| ***F02M 35/16*** | (2006.01) |
| ***F02M 35/04*** | (2006.01) |
| ***F02M 61/14*** | (2006.01) |

(52) U.S. Cl.

CPC ..... *F02M 35/162* (2013.01); *F02M 35/04* (2013.01); *F02M 35/044* (2013.01); *F02M 35/10085* (2013.01); *F02M 35/10091* (2013.01); *F02M 61/145* (2013.01)

(58) Field of Classification Search

CPC ..... F02M 35/162; F02M 35/04; F02M 35/10091; F02M 35/044; F02M 35/10085

See application file for complete search history.

(56) References Cited

U.S. PATENT DOCUMENTS

| | | | | |
|---|---|---|---|---|
| 2004/0226536 | A1* | 11/2004 | Sakai | F02B 31/06 123/308 |
| 2009/0272356 | A1* | 11/2009 | Abe | F02B 31/06 123/184.56 |
| 2011/0174273 | A1* | 7/2011 | Otsuka | F02M 69/043 123/470 |
| 2014/0041954 | A1 | 2/2014 | Yamagishi | 180/68.1 |
| 2017/0306902 | A1* | 10/2017 | Chu | F02M 35/10177 |

FOREIGN PATENT DOCUMENTS

JP 6120315 B2 4/2017

* cited by examiner

*Primary Examiner* — Jacob M Amick
(74) *Attorney, Agent, or Firm* — Stein IP, LLC

(57) ABSTRACT

An injector arrangement structure includes an air cleaner which is arranged at a rear side of an engine for a vehicle, a rear suspension which extends vertically at the rear side of the engine, and a first injector which is attached to the air cleaner. The air cleaner includes an outlet tube configuring a clean side of the air cleaner. The rear suspension and the outlet tube overlap each other in a side view. A partition wall dividing an intake passage vertically is provided inside the outlet tube. The first injector is attached from a lower side of the outlet tube so as to inject fuel toward the partition wall.

16 Claims, 7 Drawing Sheets

INJECTOR ARRANGEMENT STRUCTURE

CROSS REFERENCE TO RELATED APPLICATIONS

This application is based on Japanese Patent Application (No. 2018-077443) filed on Apr. 13, 2018, the contents of which are incorporated herein by way of reference.

BACKGROUND

The present invention relates to an injector arrangement structure.

For example, a, plurality of fuel injection valves (injectors) may be provided in an off-road type motorcycle for the purpose of improving output (for example, see Patent Document 1). In Patent Document 1, two fuel injection valves are provided in a midway of an intake passage, one of which is attached to an air cleaner, and the other is attached to a throttle body.

Particularly, when the fuel injection valve is attached to the air cleaner, the arrangement is restricted. For example, in Patent Document 1, a recessed portion is formed in a part of a case (support case) configuring the air cleaner, and the fuel injection valve is attached so as to be stored in the recessed portion.

Patent Document 1: Japanese Patent No. 6120315

SUMMARY

An injector arrangement structure includes an air cleaner which is arranged at a rear side of an engine for a vehicle, a rear suspension which extends vertically at the rear side of the engine, and a first injector which is attached to the air cleaner. The air cleaner includes an outlet tube configuring a clean side of the air cleaner. The rear suspension and the outlet tube overlap each other in a side view. A partition wall dividing an intake passage vertically is provided inside the outlet tube. The first injector is attached from a lower side of the outlet tube so as to inject fuel toward the partition wall.

DETAILED DESCRIPTION OF EXEMPLIFIED EMBODIMENTS

In Patent Document 1, since a part of the air cleaner is recessed, the capacity of the air cleaner is reduced, which may affect engine performance. Further, in order to ensure the capacity, the size of the air cleaner itself must be increased.

The present invention is made in view of the above circumstances, and an object thereof is to provide an injector arrangement structure capable of appropriately injecting fuel without reducing the capacity of an air cleaner.

Hereinafter, embodiments of the present invention are described in detail with reference to the accompanying drawings. Although an example is described in which the present invention is applied to an off-road type motorcycle, but the application subject is not limited thereto and modifications may be made. For example, the present invention may be applied to vehicles of other types. In terms of direction, an arrow FR indicates a vehicle front side, an arrow RE indicates a vehicle rear side, an arrow UP indicates a vehicle upper side, an arrow LO indicates a vehicle lower side, an arrow L indicates a vehicle left side, an arrow R indicates a vehicle right side respectively. In the following drawings, a part of components are omitted for convenience of description.

Figure 1:
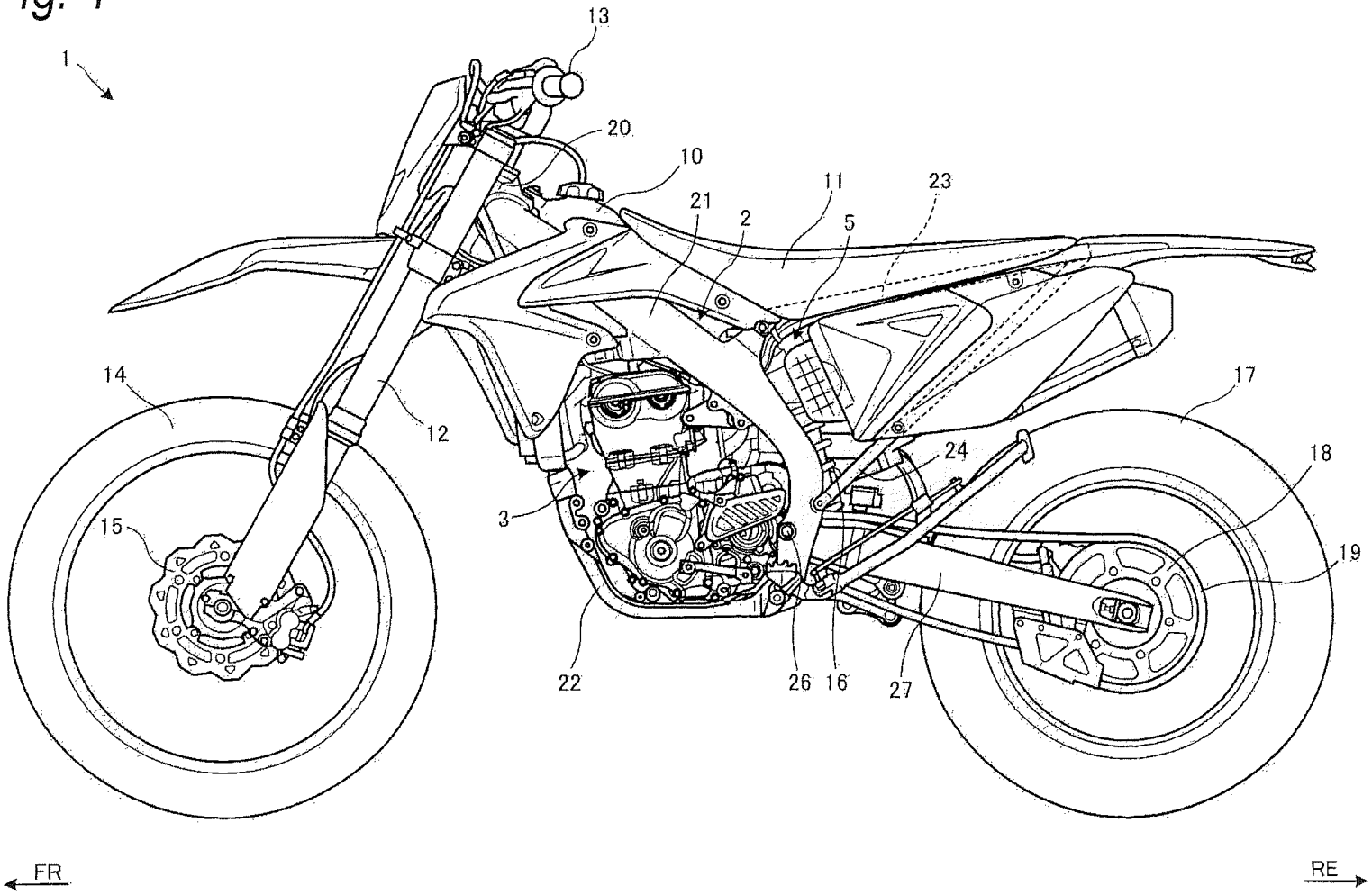
FIG. 1 is a left side view showing a schematic configuration of a motorcycle.
Figure 2:
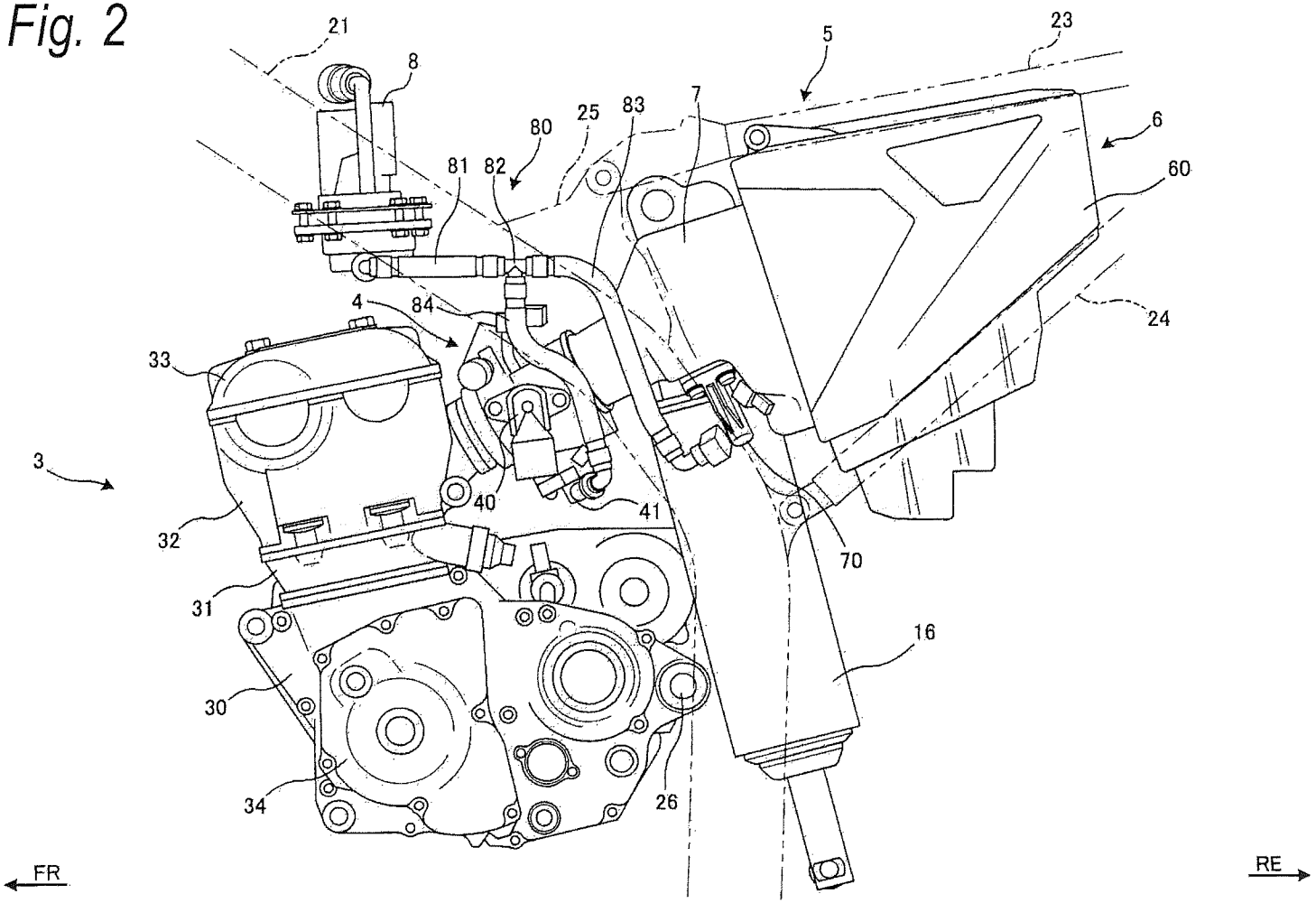
FIG. 2 is a partially enlarged view of the periphery of an engine of the motorcycle according to a present embodiment.
Figure 3:
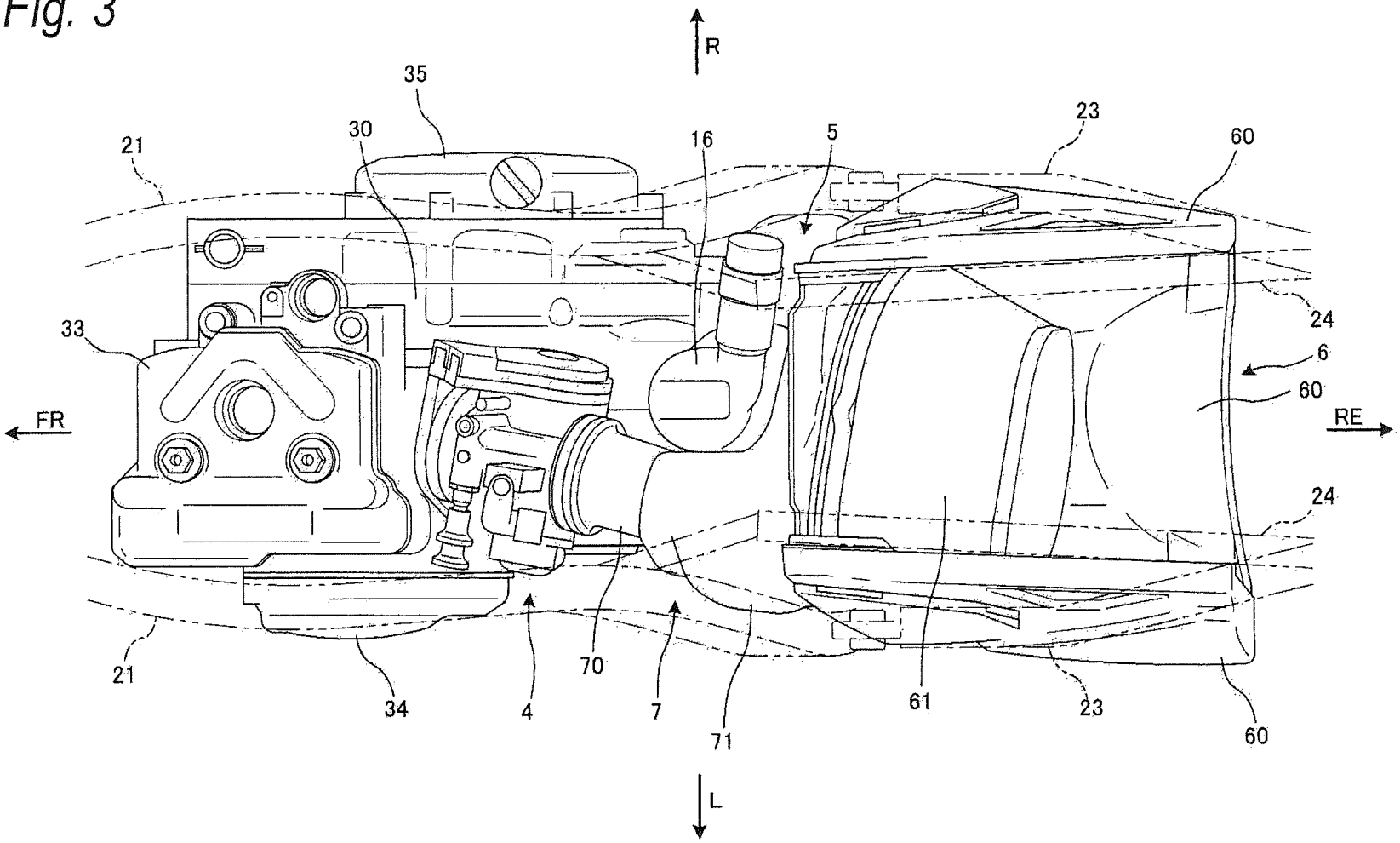
FIG. 3 is a top view of FIG. 2.

A schematic configuration of a motorcycle according to the present embodiment is described with reference to FIGS. 1 to 3. FIG. 1 is a left side view showing a schematic configuration of the motorcycle. FIG. 2 is a partially enlarged view of the vicinity of an engine of the motorcycle according to a present embodiment. FIG. 3 is a top view of FIG. 2.

As shown in FIG. 1, a motorcycle 1 according to the present embodiment is an off-road type motorcycle. The motorcycle 1 includes an engine 3 mounted on a vehicle body frame 2 made of steel or an aluminum alloy. The vehicle body frame 2 includes a main frame 21 and a down frame 22 extending rearward and downward from a head pipe 20, and a pair of left and right seat frames 23 and a pair of left and right rear frame 24 extending rearward and upward from a midway of the main frame 21.

The main frame 21 is branched leftward and rightward from the head pipe 20 toward rearward and extends obliquely downward toward the rear of a vehicle body. Further, the main frame 21 is bent downward in a vertical direction at the rear side of the engine and extends at the lower side of the engine 3. A fuel tank 10 is arranged between the pair of main frames 21.

Each down frame 22 extends downward from the head pipe 20 and then bends in a horizontal direction at a lower portion of the vehicle body and extends rearward. A rear end of the down frame 22 is connected to a lower end of the main frame 21. The engine 3 is arranged in a space surrounded by the main frame 21 and the down frame 22.

Each seat frames 23 extends rearward and upward from a front upper side of a bent portion of the main frame 21. The rear frame 24 extends rearward and upward from a midway portion (bent portion) of the main frame 21 extending downward, and a rear end thereof is connected to a rear end of a seat frame 23. At a rear of the fuel tank 10, a seat 11 is provided along the seat frames 23. A frame bridge 25 which connects the pair of main frames 21 to each other is provided in the vicinity of a connecting portion between the seat frame 23 and the main frame 21.

The engine 3 includes a crankcase 30, a cylinder block 31, a cylinder head 32, and a cylinder head cover 33 which are attached to an upper portion of the crankcase 30 in order from the bottom. The crankcase 30 includes left and right split cases, and a crankshaft (not shown) having a center axis in a vehicle width direction (left-right direction) is housed in the crankcase 30. Further, both left and right sides of the crankcase 30 are open, and a cover is attached so as to close each opening. Specifically, a magnet cover 34 is attached to the left side of the crankcase 30, and a clutch cover 35 is attached to the right side of the crankcase 30.

A front fork 12 is rotatably supported by the head pipe 20 via a steering shaft (not shown). A handlebar 13 is provided at an upper end of the steering shaft. A front wheel 14 is rotatably supported at a lower portion of the front fork 12. The front wheel 14 is provided with a brake disk 15 configuring a braking device.

A pivot portion 26 is provided at a rear portion of the crankcase 30 and a lower end side of the main frame 21, and a swing arm 27 is swingably connected to the pivot portion 26 in an upper-lower direction. A rear suspension 16 which connects the vehicle body frame 2 and the swing arm 27 is provided above the pivot portion 26. The rear suspension 16 extends vertically at the rear side of the engine 3. The rear suspension 16 is arranged at a position slightly shifted to a right side in the vehicle width direction in front of a dirty side portion 6 of an air cleaner 5 to be described below. A rear wheel 17 is rotatably supported at a rear end of the swing arm 10. A driven sprocket 18 is provided at a left side of the rear wheel 17, and the power of the engine is transmitted to the rear wheel 17 by a chain 19.

A throttle body 4 and the air cleaner 5 are arranged at the rear side of the engine 3 as intake system components. Although a specific configuration of the intake system components will be described below, the throttle body 4 and the air cleaner 5 are attached in this order to an intake port located on a rear side of the engine 3. That is, the throttle body 4 is connected between the intake port and the air cleaner 5 (outlet tube 7 to be described below).

The air cleaner 5 includes the dirty side portion 6 having a triangular shape in a side view configuring a dirty side, and the outlet tube 7 configuring a clean side. The dirty side portion 6 has a complementary shape to a space surrounded by the pair of seat frames 23 and the rear frame 24 below the seat 11, and forms a box-shaped space by a partition wall 60 which covers the front side, the lateral side, and the lower side. An air filter 61 is housed in the dirty side portion 6. An upstream end of the outlet tube 7 is connected to a front surface of the dirty side portion 6, and a downstream end thereof is connected to the throttle body 4. As will be described in detail later, a first injector 70 is attached to the outlet tube 7 as a fuel injection device.

The throttle body 4 is provided with a valve body (not shown) therein and adjusts a flow rate of intake air according to an opening degree of the valve body. The throttle body 4 includes a throttle sensor 40 which detects the opening degree of the valve body on a side surface thereof. A second injector 41 is attached to the throttle body 4 as another fuel injection device. Specifically, the second injector 41 is attached to the throttle body 4 from a lower side, and an axial direction thereof is directed in the vertical direction.

Further, a fuel pump 8 is arranged between the pair of main frames 21 above the cylinder head cover 33. The fuel pump 8 supplies the fuel from the fuel tank 10 to each injector (the first injector 70 and the second injector 41). As shown in FIG. 2, one end side of the fuel pipe 80 is connected to the fuel pump 8, and the other end side of the fuel pipe 80 is branched into two in the midway and is connected to each injector.

Specifically, the fuel pipe 80 includes a first fuel pipe 81 extending rearward from a lower end of the fuel pump 8, a three-way joint 82 (also called a T-shaped joint) attached to a downstream end of the first fuel pipe 81, and a second fuel pipe 83 and a third fuel pipe 84 connected to an upstream end of the three-way joint 82. A downstream end of the second fuel pipe 83 is connected to the first injector 70, and a downstream end of the third fuel pipe 84 is connected to the second injector 41. The three-way joint 82 is positioned directly above the throttle body 4. That is, the second fuel pipe 83 for the first injector 70 and the third fuel pipe 84 for the second injector 41 join together above the throttle body 4.

Air is taken into the engine 3 through the air cleaner 5 and the throttle body 4. In the engine 3, a mixture of air and fuel is supplied to a combustion chamber. Combustion gas after the air-fuel mixture is burned in the combustion chamber is discharged from a muffler through an exhaust pipe (not shown).

Incidentally, in the off-road type motorcycle, a plurality of injectors may be provided for the purpose of improving the output. For example, as described above, two injectors are provided in a midway of an intake passage, one of which is attached to the air cleaner, and the other one is attached to the throttle body.

Particularly, when the injector is attached to the air cleaner, the arrangement is restricted. For example, it is considered to provide a recess in a part of the air cleaner so as to ensure a seat for attaching the injector. However, when a part of the air cleaner is recessed, the capacity of the air cleaner is reduced, which may affect engine performance. Further, in order to ensure the capacity, the size of the air cleaner itself must be increased. In the case of the motorcycle 1 described above, since the frame bridge 25 is present above the outlet tube 7, it is difficult to attach the injector from above the outlet tube 7.

Therefore, the present inventors focused on a balance with a peripheral configuration of the air cleaner 5 and an internal structure of the air cleaner 5 (outlet tube 7), and conceived an injector arrangement structure which can inject fuel properly without reducing the capacity of the air cleaner.

Specifically, in the present embodiment, the outlet tube 7 and the rear suspension 16 are arranged so as to overlap each other in the side view, and the first injector 70 is attached to a lateral side of the rear suspension 16 from the lower side of the outlet tube 7. As will be described in detail later, a partition wall 91 (see FIG. 5) which vertically divides the intake passage is provided inside the outlet tube 7 (chamber portion 71), and the first injector 70 is arranged with a tip end thereof facing the partition wall 91 so as to inject fuel toward the partition wall 91.

The configuration of the frame bridge 25, the seat 11, and a support portion on an upper end side of the rear suspension 16 or the like is concentrated above the air cleaner 5 (the outlet tube 7), and when the injector is attached from above the air cleaner 5, it is necessary to cut the capacity of the air cleaner 5. According to the present embodiment, since a space is ensured below the outlet tube 7, the first injector 70 can be attached to the outlet tube 7 without sacrificing the capacity of the air cleaner 5. In addition, since the tip end of the first injector 70 faces the partition wall 91 in the outlet tube 7, the fuel can be injected toward the partition wall 91. When the fuel hits the partition wall, atomization of the fuel is promoted, so that air and fuel are easily mixed in the intake passage, and the air-fuel mixture can be properly fed into the engine 3.

Figure 4A:
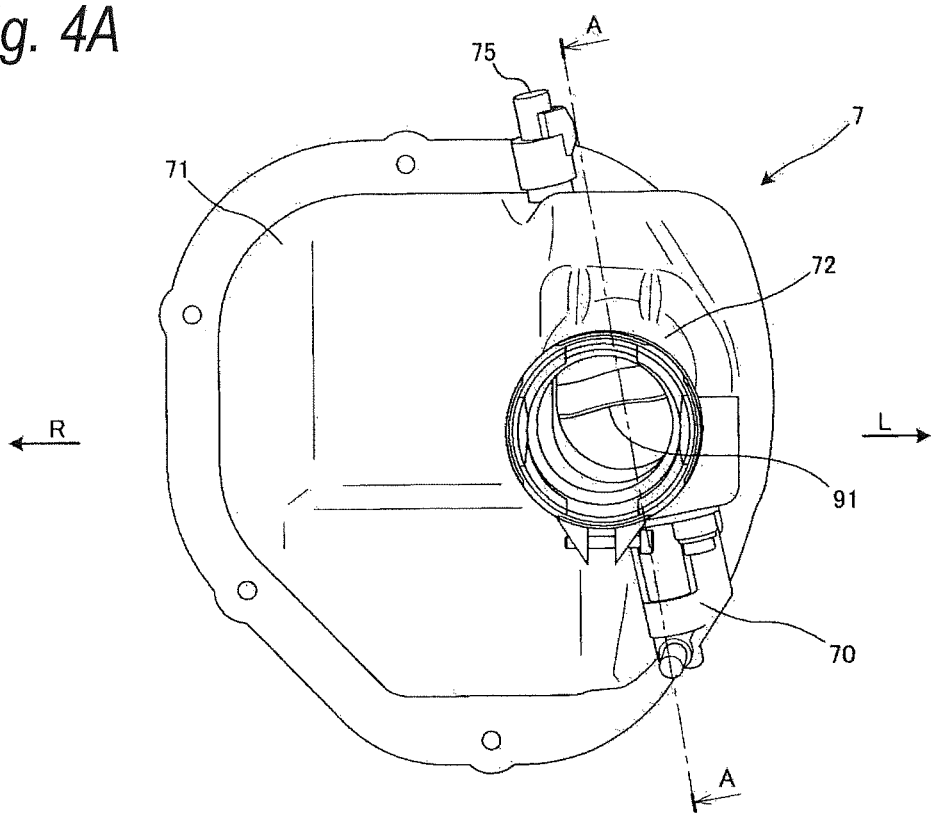
FIGS. 4A and 4B are a front view and a bottom view of an intake system component (outlet tube) according to the present embodiment.
Figure 4B:
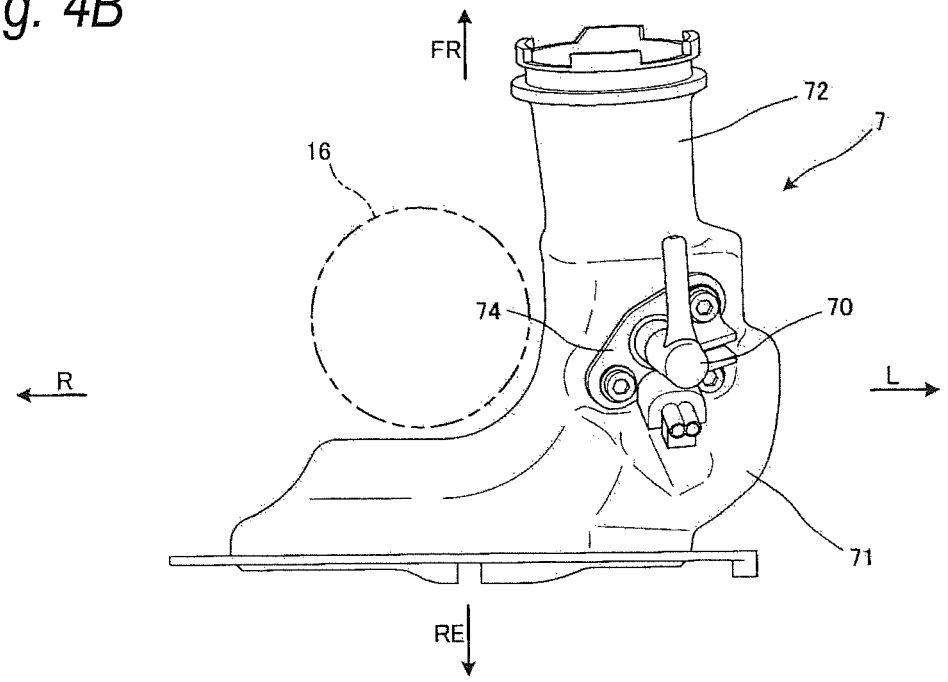
Figure 5:
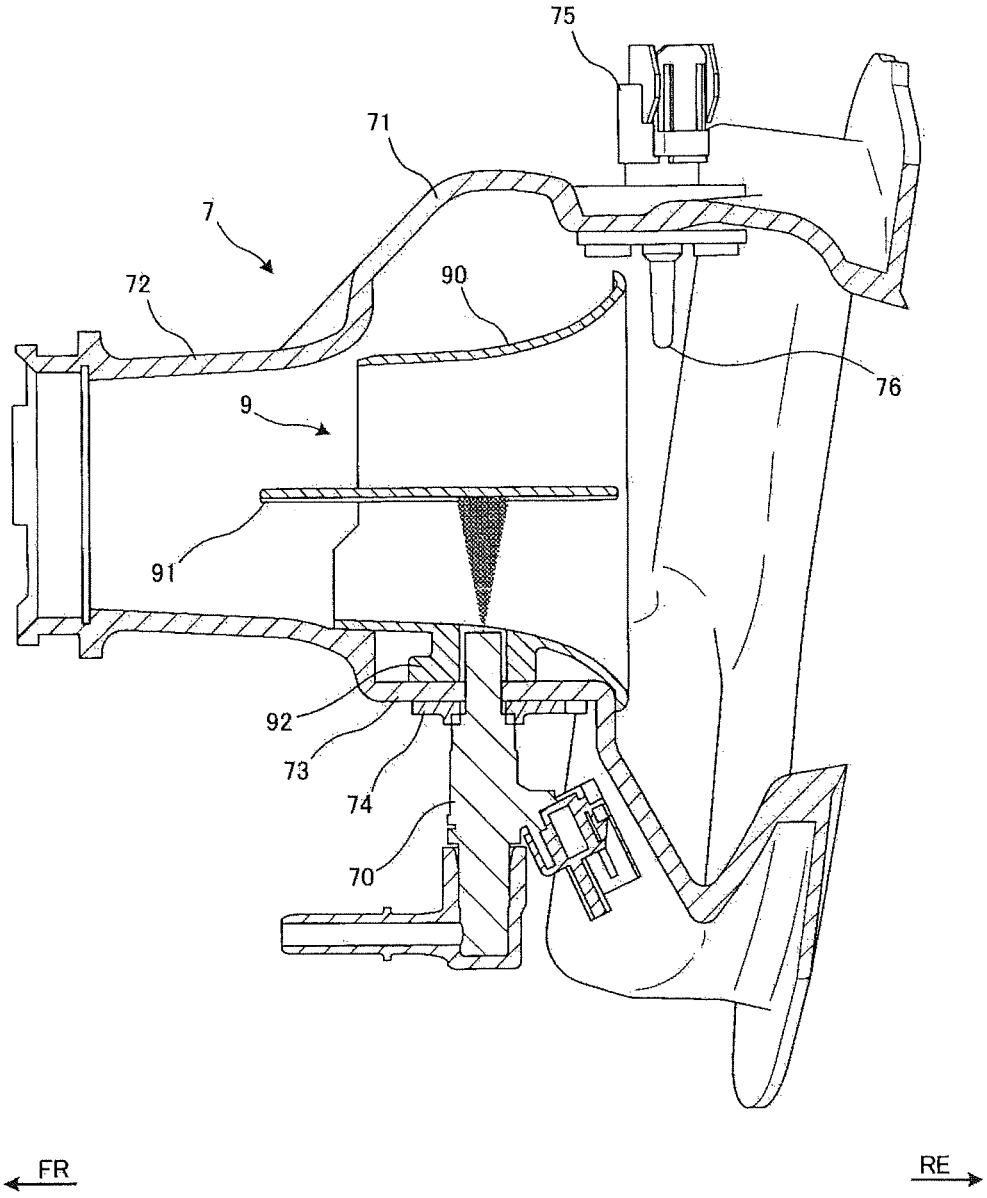
FIG. 5 is a cross-sectional view of the outlet tube shown in FIGS. 4A and 4B.
Figure 6A:
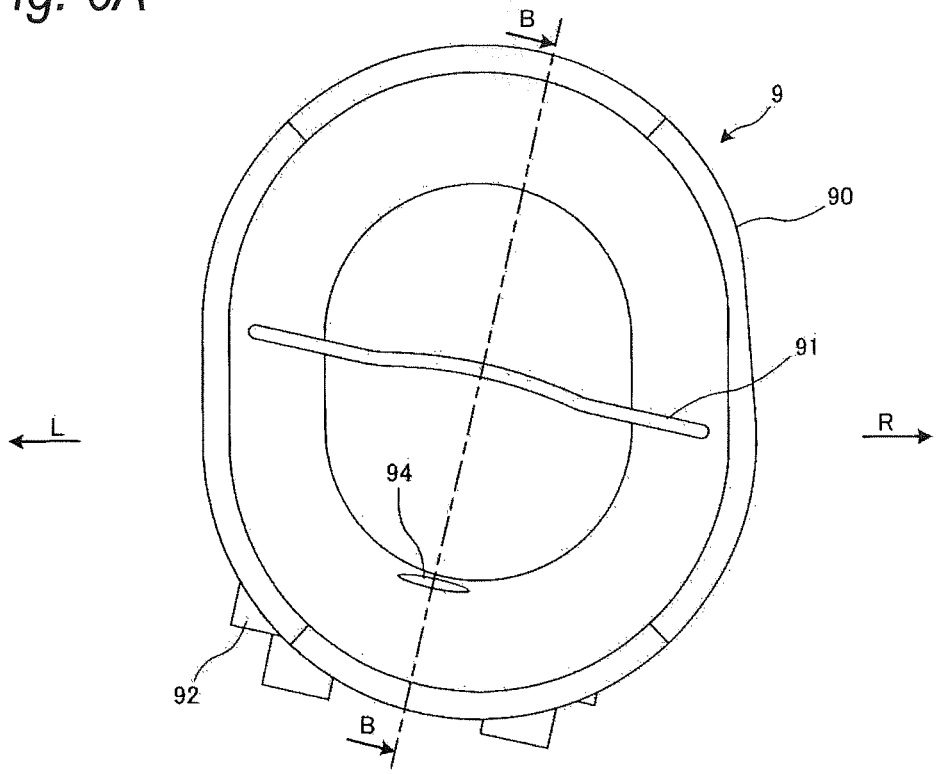
FIGS. 6A and 6B are a back view and a bottom view of a funnel according to the present embodiment.
Figure 6B:
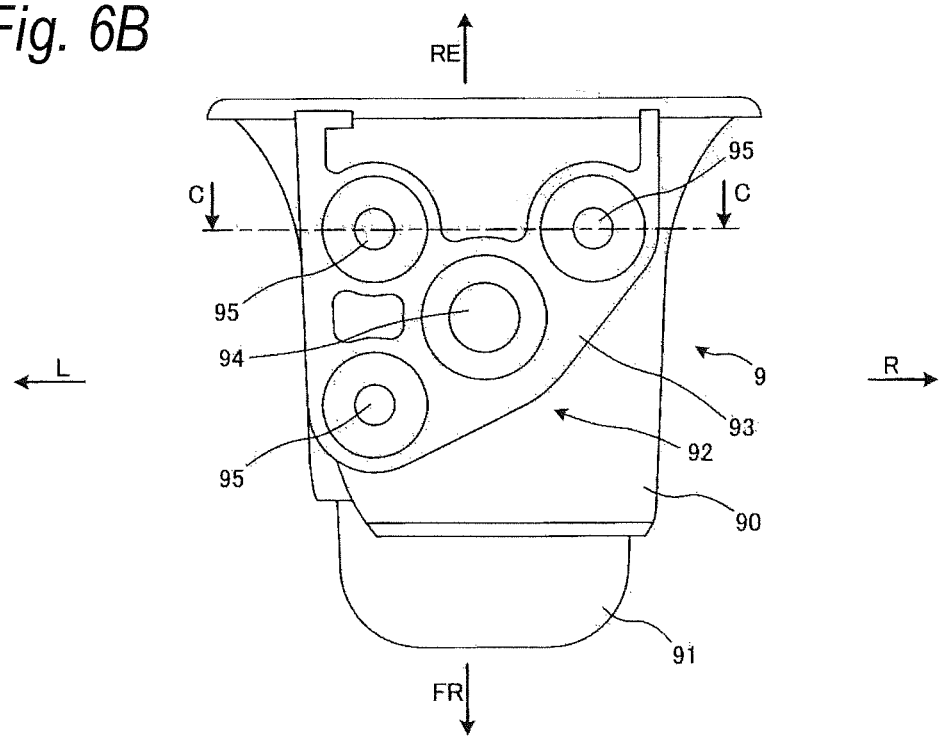
Figure 7A:
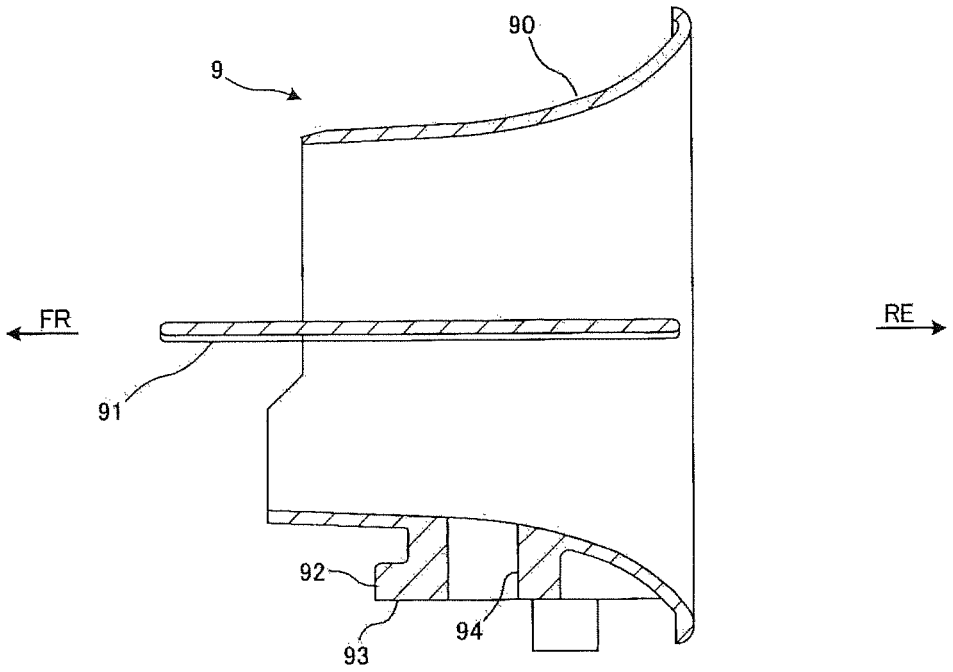
FIGS. 7A and 7B are cross-sectional views of the funnel shown in FIGS. 6*a* and 6B.
Figure 7B:
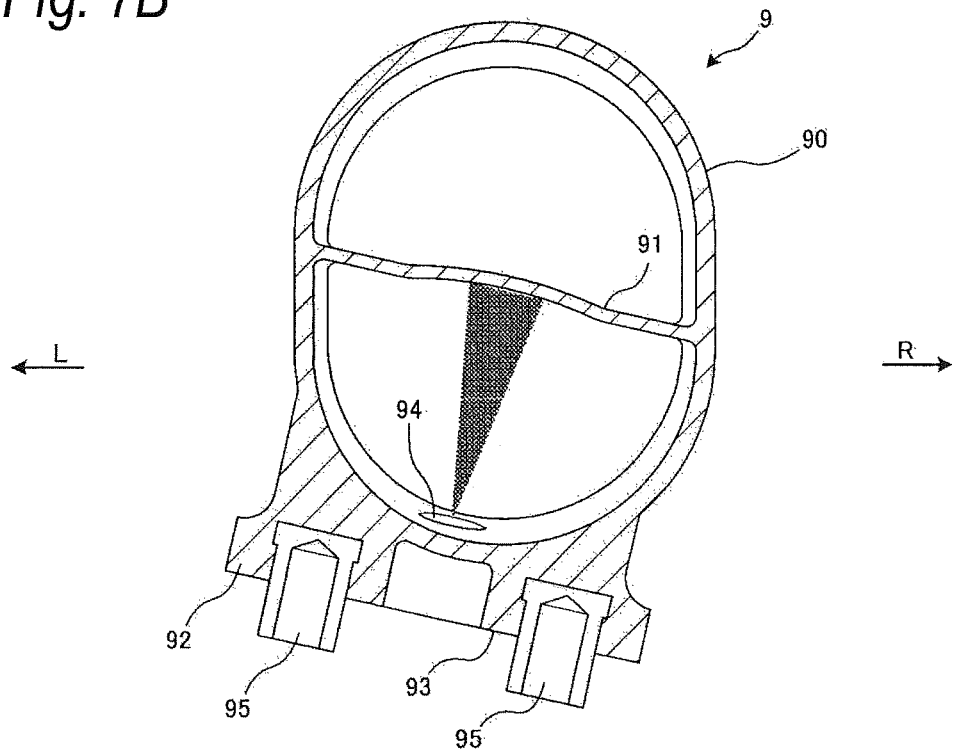

Next, the arrangement structure of the injectors and the internal structure of the outlet tube according to the present embodiment will be described with reference to FIGS. 2 to 7A and 7B. FIGS. 4A and 4*b* are a front view (FIG. 4A) and a bottom view (FIG. 4B) of the intake system component (outlet tube) according to the present embodiment. FIG. 5 is a cross-sectional view of the outlet tube shown in FIGS. 4A and 4B. Specifically, FIG. 5 is a cross-sectional view taken along a line A-A of FIG. 4A. FIGS. 6A and 6B are a back view (FIG. 6A) and a bottom view (FIG. 6B) of the funnel according to the present embodiment. FIGS. 7A and 7B are cross-sectional views of the funnel shown in FIGS. 6A and 6B. Specifically, FIG. 7A is a cross-sectional view taken along a line B-B of FIG. 6A, and FIG. 7B is a cross-sectional view taken along a line C-C of FIG. 6B.

As shown in FIGS. 2 and 3, the throttle body 4 and the outlet tube 7 are arranged so as to be sandwiched between the pair of main frames 21. That is, the intake system component connected to the intake port is housed in the left-right width of the pair of main frames 21. As described above, the outlet tube 7 configures the clean side of the air cleaner 5, and is formed such that a diameter of the intake passage decreases from an upstream to a downstream, that is, from the rear side toward the front side.

Specifically, as shown in FIGS. 3 to 5, the outlet tube 7 includes a chamber portion 71 connected to the front surface of the dirty side portion 6, and a tubular connection portion 72 formed continuously to a downstream side of the chamber portion 71 and connected to the throttle body 4 on an intake port side.

The chamber portion 71 has a circular shape having substantially the same diameter as a left-right width of the dirty side portion 6 in the front view. The chamber portion 71 protrudes in a tubular shape from the front surface of the dirty side portion 6, and extends in a curved manner to the left in the vehicle width direction so as to gradually reduce the diameter while avoiding the rear suspension on a right front side. A tubular connection portion 72 is continuous to a tip end which is a downstream end of the chamber portion 71. In this way, the chamber portion 71 has a shape expanded in diameter with respect to the connection portion 72.

A funnel 9 for guiding the flow of the intake air is provided in the chamber portion 71. The funnel 9 is formed separately from the outlet tube 7. Specifically, as shown in FIGS. 5 to 7A and 7B, the funnel 9 includes a tubular portion 90 having a center axis in a front-rear direction, and the partition wall 91 dividing the intake passage vertically at a center of the tubular portion 90. The tubular portion 90 is formed such that a diameter thereof decreases from the upstream to the downstream. That is, the tubular portion 90 has a bell mouth shape in which an upstream end side is expanded in diameter. A downstream end of the tubular portion 90 is connected to an upstream end of the connection portion 72. The tubular portion 90 has an elliptic shape long in the upper-lower direction when viewed from the axial direction (see FIG. 6).

The partition wall 91 is formed of a plate-like body extending in the left-right direction so as to vertically partition a space in the tubular portion 90. A downstream end, which is a tip end of the partition wall 91, protrudes more toward a connection portion 72 side than a tip end (downstream end) of the tubular portion 90, and enters a space in the connecting portion 72. On the other hand, an upstream end, which is a rear end of the partition wall 91, is positioned substantially at a same position as a rear end (upstream end) of the tubular portion 90, or slightly inner side than the rear end of the tubular portion 90 (see FIGS. 5 and 7A). The partition wall 91 is slightly inclined with respect to the horizontal direction such that a left end side is positioned on an upper side with respect to a right end side (see FIGS. 6A and 7B). Further, the partition wall 91 has a curved shape such that a center portion thereof is slightly bulged upward (a side opposite to the first injector 70).

An attachment portion 92 for fixing the tubular portion 90 to the chamber portion 71 is formed at a lower end portion of the tubular portion 90. The attachment portion 92 protrudes downward from an outer surface of the tubular portion 90 and includes an attachment seat surface 93 substantially parallel to a surface of the partition wall 91. A through hole 94 penetrating from a lower surface (seating surface) side toward the center of the partition wall 91 is formed in the attachment portion 92. As will be described in detail later, the tip end of the first injector 70 is inserted into the through hole 94. Three screw holes 95 for attaching a fixing screw (not shown) are formed around the through hole 94.

A flat portion 73 corresponding to the attachment portion 92 is formed on a lower surface of a tip end (downstream end) side of the chamber portion 71 decreased in diameter. A hole (not shown) corresponding to the through hole 94 and the screw holes 95 is formed in the flat portion 73. A plate-shaped flange portion 74 is provided on a lower surface of the flat portion 73. A hole (not shown) for inserting a screw or the first injector 70 is formed in the flange portion 74 so as to correspond to the hole of the flat portion 73.

The funnel 9 is fixed to the outlet tube 7 by aligning the attachment portion 92 with the flat portion 73 and screwing the flat portion 73 from the lower side of the flange portion 74 in a state of being sandwiched between the attachment portion 92 and the flange portion 74. The first injector 70 is fixed to the outlet tube 7 by being screwed into the chamber portion 71 and the flange portion 74 from the lower side of the flange portion 74. The axial direction of the first injector 70 is directed in the vertical direction. At this time, the tip end of the first injector 70 is inserted into the through hole 94 and is directed to a curved portion at the center of the partition wall 91. In this way, the funnel 9 and the first injector 70 are fixed to the outlet tube 7 by jointly fastening.

An intake pressure sensor 75 which detects an intake pressure of the intake air is attached to an upper end of the chamber portion 71. Specifically, the intake pressure sensor 75 is attached from above the chamber portion 71, and the axial direction thereof is directed in the vertical direction. A detection portion 76, which is a tip end of the intake pressure sensor 75, enters the chamber portion 71. As shown in FIG. 5, a tip end of the detection portion 76 is positioned rearward than the downstream end of the tubular portion 90 and radially inward than an outer edge of the diameter-expanded tubular portion 90. Accordingly, it is possible to detect the intake pressure of the intake air flowing toward the funnel 9 on the upstream side (rear side) of the funnel 9. The tip end of the detection portion 76 is positioned on the side opposite to the first injector 70 with the partition wall 91 interposed therebetween.

In the air cleaner 5 configured as described above, when the fuel is injected from the first injector 70, as shown in FIGS. 5 and 7B, the fuel collides with the partition wall 91. Particularly, as shown in FIG. 7B, since the center portion of the partition wall 91 has a curved shape so as to bulge upward at a predetermined radius of curvature, the fuel which hits the surface of the partition wall 91 is easily retained (retained) in the curved partition wall 91. Since the flow of the intake air is fast in a center of the intake passage, the atomization of the fuel diffused in the center of the intake passage is promoted. As a result, the intake air and the fuel are easily mixed.

Further, as shown in FIG. 5, since the partition wall 91 extends long in the axial direction with respect to the tubular portion 90, it is possible to improve the degree of freedom at the attachment position in the axis direction of the first injector 70 so as to make the fuel hit the partition wall 91.

The partition wall 91 and the first injector 70 are provided in the chamber portion 71 having an expanded diameter with respect to that of the connection portion 72. In the chamber portion 71 having a relatively large diameter, the degree of freedom is obtained at the attachment position of the first injector 70, and the volume of the air cleaner 5 is easily ensured. In addition, the first injector 70 can be arranged on the upstream side (rear side) of the intake port, and the distance to the intake port can be ensured. Accordingly, it is possible to sufficiently ensure the time required for the atomization of the fuel injected into the partition wall 91.

Further, since the funnel 9 separate from the outlet tube 7 is arranged in the chamber portion 71 and the partition wall 91 is provided in the funnel 9, it is possible to ensure the degree of freedom at the attachment position of the funnel 9 (the position of the partition wall 91) in the chamber portion 71. Further, by forming the partition wall 91 in the funnel 9, it is possible to increase the strength (rigidity) of the partition wall 91 itself.

Further, since the funnel 9 (tubular portion 90) has a vertically long elliptic shape and decreases in diameter from the upstream to the downstream of the intake air, the funnel 9 can avoid the rear suspension 16 without interfering with the rear suspension 16. Therefore, the intake passage can be linearly extended forward and backward, and the intake resistance can be reduced.

Further, since a tip end (downstream end) of the partition wall 91 extends forward than the front end (downstream end) of the tubular portion 90, it is possible to keep the fuel adhering to the partition wall 91 at the center of the intake passage for a relatively long time. As a result, the intake air and the fuel can be easily mixed. In addition, it is possible to suppress the spread of the blow back from the engine 3 in the chamber portion 71 by the partition wall 91.

Further, since the funnel 9 is fixed to the outlet tube by being fastened together with the first injector 70, it is possible to suppress the positional deviation of the funnel 9 and the first injector 70. As a result, the fuel can be more accurately injected toward the partition wall.

Further, since the tip end (detection portion 76) of the intake pressure sensor 75 is positioned on the side opposite to the first injector 70 with the partition wall 91 interposed therebetween, it is possible to prevent the fuel injected from the first injector 70 from directly hitting the intake pressure sensor 75. As a result, it is possible to appropriately detect the intake pressure without affecting the detection accuracy of the intake pressure sensor 75.

Further, since the first injector 70 is provided at a position overlapping with the rear suspension 16 inside the pair of main frames 21 in the side view, the first injector 70 can be protected from an external factor. Further, since there is a comparatively space on the lateral side of the rear suspension 16, it is possible to ensure the maintainability.

Further, in the present embodiment, by adopting two injectors (the first injector 70 and the second injector 41), it is possible to control the fuel injection amount more finely. Further, since the three-way joint 82 configuring a part of the fuel pipe 80 is arranged above the throttle body 4 and the second fuel pipe 83 and the third fuel pipe 84 are arranged at the rear side of the throttle sensor 40, it is possible to prevent the fuel pipe 80 from interfering with other components and simplify the fuel pipe 80 itself. Further, the lengths of the second fuel pipe 83 and the third fuel pipe 84 can be equalized, and the fuel pressure of each injector can also be equalized.

As described above, in the present embodiment, since the outlet tube 7 and the rear suspension 16 are arranged so as to overlap each other in the side view, and the first injector 70 is attached from the lower side of the outlet tube 7 on the side of the rear suspension 16, the first injector 70 can be arranged without sacrificing the capacity of the air cleaner 5. In addition, since the partition wall 91 is provided in the outlet tube 7 and the first injector 70 is arranged so as to inject the fuel toward the partition wall 91, the fuel can be appropriately injected.

The off-road type motorcycle 1 has been described as an example in the above embodiment, but the present invention is not limited to this configuration. The arrangement structure of the injectors according to the present embodiment is also applicable to other types of motorcycles.

In the above embodiment, two injectors are provided, but the present invention is not limited to this configuration. For example, the second injector 41 is not necessarily provided. Incidentally, the above injectors described above are numbered first, second, but the numbers are given for convenience of description and do not represent the priority or order of the injectors.

Although a plurality of embodiments and modifications have been described, the present embodiments and the modifications may be combined in whole or in part as another embodiment of the present invention.

Further, embodiments of the present invention are not limited to the above embodiments, and changes, substitutions and modifications may be made without departing from the spirit of the technical concept of the present invention. Further, the present invention may be implemented by using other methods as long as the technical concept of the present invention can be implemented by the methods through advance of technology or other derivative technology. Therefore, the scope of claims covers all embodiments that may fall within the scope of the technical concept.

As described above, the present invention has an effect that fuel can be appropriately injected without reducing the capacity of the air cleaner, and is particularly useful for the arrangement structure of the injectors applicable to the off-road type motorcycle.

What is claimed is:

1. An injector arrangement structure comprising:

an air cleaner which is arranged at a rear side of an engine for a vehicle;

a rear suspension which extends vertically at the rear side of the engine; and a first injector which is attached to the air cleaner, wherein the air cleaner includes an outlet tube configuring a clean side of the air cleaner, the rear suspension and the outlet tube overlap each other in a side view, a partition wall dividing an intake passage vertically is provided inside the outlet tube at a center of the intake passage, and the first injector is attached from a lower side of the outlet tube so as to inject fuel upward toward the partition wall.

2. The injector arrangement structure according to claim 1, wherein the outlet tube includes a chamber portion which is connected to a dirty side of the air cleaner and a tubular connection portion which is formed continuously to a downstream side of the chamber portion and connected to an intake port side of the engine, the chamber portion has a shape expanded in diameter with respect to the connection portion, and the partition wall and the first injector are provided in the chamber portion.

3. The injector arrangement structure according to claim 2, wherein a funnel which is separated from the chamber portion is arranged in the chamber portion, and the partition wall is provided in the funnel.

4. The injector arrangement structure according to claim 3, wherein the funnel has an elliptic shape long in an upper-lower direction when viewed from an axial direction of the funnel, a diameter of the funnel decreases from an upstream to a downstream, and a downstream end of the funnel is connected to an upstream end of the connection portion.

5. The injector arrangement structure according to claim 3, wherein a downstream end of the partition wall protrudes more toward the connection portion than the downstream end of the funnel.

6. The injector arrangement structure according to claim 3, wherein the partition wall has a shape in which a center portion thereof is curved to a side opposite to the first injector when viewed from the axial direction of the funnel.

7. The injector arrangement structure according to claim 3, wherein the funnel and the first injector are fixed to the outlet tube by jointly fastening.

8. The injector arrangement structure according to claim 3 further comprising:

an intake pressure sensor which detects an intake pressure on an upstream side of the funnel, wherein the intake pressure sensor is attached to the chamber portion on the side opposite to the first injector with respect to the partition wall interposed therebetween.

9. The injector arrangement structure according to claim 1 further comprising:

a vehicle body frame on which the engine is mounted, wherein the vehicle body frame includes a pair of main frames extending rearward and downward from a head pipe, and wherein the first injector is provided at a position overlapping with the rear suspension in the side view and between the pair of main frames.

10. The injector arrangement structure according to claim 1 further comprising:

a throttle body which is connected an intake port of the engine and the outlet tube therebetween; and a second injector which is attached to the throttle body from the lower side, wherein a fuel pipe for the first injector and a fuel pipe for the second injector join together at an upper side of the throttle body.

11. An injector arrangement structure comprising:

an air cleaner which is arranged at a rear side of an engine for a vehicle;

a rear suspension which extends vertically at the rear side of the engine; and a first injector which is attached to the air cleaner, wherein the air cleaner includes an outlet tube configuring a clean side of the air cleaner, the rear suspension and the outlet tube overlap each other in a side view, a partition wall dividing an intake passage vertically is provided inside the outlet tube, the first injector is attached from a lower side of the outlet tube so as to inject fuel toward the partition wall, the outlet tube includes a chamber portion which is connected to a dirty side of the air cleaner and a tubular connection portion which is formed continuously to a downstream side of the chamber portion and connected to an intake port side of the engine, the chamber portion has a shape expanded in diameter with respect to the connection portion, the partition wall and the first injector are provided in the chamber portion, a funnel which is separated from the chamber portion is arranged in the chamber portion, and the partition wall is provided in the funnel.

12. The injector arrangement structure according to claim 11, wherein the funnel has an elliptic shape long in an upper-lower direction when viewed from an axial direction of the funnel, a diameter of the funnel decreases from an upstream to a downstream, and a downstream end of the funnel is connected to an upstream end of the connection portion.

13. The injector arrangement structure according to claim 11, wherein a downstream end of the partition wall protrudes more toward the connection portion than the downstream end of the funnel.

14. The injector arrangement structure according to claim 11, wherein the partition wall has a shape in which a center portion thereof is curved to a side opposite to the first injector when viewed from the axial direction of the funnel.

15. The injector arrangement structure according to claim 11, wherein the funnel and the first injector are fixed to the outlet tube by jointly fastening.

16. The injector arrangement structure according to claim 11 further comprising:

an intake pressure sensor which detects an intake pressure on an upstream side of the funnel.

* * * * *